US008474686B2

(12) United States Patent
Glaser et al.

(10) Patent No.: US 8,474,686 B2
(45) **Date of Patent: *Jul. 2, 2013**

(54) CORRUGATED CONTAINER

(75) Inventors: John T. Glaser, Columbia, MD (US); Mark Jasko, River Edge, NJ (US)

(73) Assignee: Fisher Scientific Company L.L.C., Hampton, NH (US)

( * ) Notice: Subject to any disclaimer, the term of this patent is extended or adjusted under 35 U.S.C. 154(b) by 417 days.

This patent is subject to a terminal disclaimer.

(21) Appl. No.: 12/629,289

(22) Filed: Dec. 2, 2009

(65) Prior Publication Data

US 2010/0072105 A1 Mar. 25, 2010

Related U.S. Application Data

(63) Continuation of application No. 11/279,784, filed on Apr. 14, 2006, now Pat. No. 7,644,858.

(60) Provisional application No. 60/676,878, filed on May 2, 2005.

(51) Int. Cl.

| | |
|---|---|
| ***B65D 5/46*** | (2006.01) |
| ***B65D 3/00*** | (2006.01) |
| ***B65D 25/04*** | (2006.01) |
| ***B65D 3/22*** | (2006.01) |

(52) U.S. Cl.
USPC ..... 229/117.16; 229/120.36; 229/117.28; 229/122.34

(58) Field of Classification Search
USPC ..... 229/117.16, 117.28, 120.36, 122.34
See application file for complete search history.

(56) References Cited

U.S. PATENT DOCUMENTS

| | | | | |
|---|---|---|---|---|
| 1,647,581 | A | | 11/1927 | Redemski |
| 1,917,886 | A | | 7/1933 | Hogan |
| 1,963,677 | A | * | 6/1934 | Roberts ..... 206/427 |
| 1,970,582 | A | | 8/1934 | Snyder et al. |
| 1,976,530 | A | * | 10/1934 | Verhoven ..... 229/117.17 |
| 2,021,235 | A | * | 11/1935 | Gomes ..... 229/117.16 |
| 2,151,472 | A | * | 3/1939 | Hubbard ..... 229/120.36 |

(Continued)

FOREIGN PATENT DOCUMENTS

GB 2 220 193 A 1/1990

OTHER PUBLICATIONS

United States Patent and Trademark Office, Non-Final Office Action, U.S. Appl. No. 11/279,784, Mailed Sep. 29, 2008.

(Continued)

*Primary Examiner* — Nathan J Newhouse
*Assistant Examiner* — Latrice Byrd
(74) *Attorney, Agent, or Firm* — Wood, Herron & Evans, LLP

(57) ABSTRACT

A corrugated container for shipping containers, such as glass bottles, includes a shipping box, a liner, one or more cross-pieces, a top sheet and a bottom sheet. The liner, cross-pieces, top sheet and bottom sheet may be made of corrugated or hexacomb material to provide shock absorbing protection to the bottles received within the shipping box. The liner and cross-pieces do not extend the full height of the box to allow the corners of the box to crush or crumple in the event the container is dropped on one of its upper corners. A pair of staggered hand holes may be formed in the opposite sides of the box to enable ergonomic lifting of the container.

11 Claims, 5 Drawing Sheets

U.S. PATENT DOCUMENTS

| | | | |
|---|---|---|---|
| 2,404,067 | A | 7/1946 | Hill |
| 2,570,340 | A | 10/1951 | George |
| 2,578,775 | A | 12/1951 | Belsinger |
| 2,671,600 | A | 3/1954 | Leavitt |
| 2,788,933 | A | 4/1957 | Kessler |
| 2,909,311 | A | 10/1959 | Levitt |
| 2,920,782 | A | 1/1960 | Butters |
| 2,925,210 | A | 2/1960 | Fallert |
| 3,003,680 | A | 10/1961 | Wilcox, Jr. |
| 3,005,717 | A | 10/1961 | Pilibos |
| 3,044,679 | A | 7/1962 | Wheeler et al. |
| 3,866,523 | A | 2/1975 | Geschwender |
| 4,071,185 | A | 1/1978 | Peters, Jr. |
| 4,164,312 | A | 8/1979 | Harned |
| 4,335,842 | A | 6/1982 | Bradford et al. |
| 4,376,507 | A | 3/1983 | Nauheimer |
| 4,492,332 | A | 1/1985 | Collins |
| 4,504,497 | A | 3/1985 | Kurth et al. |
| 4,706,809 | A | 11/1987 | Halsell |
| 4,798,290 | A | 1/1989 | Bradford |
| 4,842,189 | A | 6/1989 | Czosnyka |
| 5,000,372 | A | 3/1991 | Hollander et al. |
| 5,040,696 | A | 8/1991 | Liebel |
| 5,042,260 | A | 8/1991 | George, Sr. |
| 5,190,212 | A | 3/1993 | Morris |
| 5,429,264 | A | 7/1995 | Hollander et al. |
| 5,462,171 | A | 10/1995 | Moog et al. |
| 5,540,972 | A | 7/1996 | Jaegers et al. |
| 6,536,654 | B2 | 3/2003 | Reynolds et al. |
| 6,910,582 | B2 | 6/2005 | Lantz |
| 7,644,858 | B2 * | 1/2010 | Glaser et al. ..... 229/117.16 |
| 2002/0117540 | A1 | 8/2002 | Reynolds et al. |

OTHER PUBLICATIONS

United States Patent and Trademark Office, Non-Final Office Action, U.S. Appl. No. 11/279,784, Mailed Jun. 3, 2009.

* cited by examiner

CORRUGATED CONTAINER

This application is a continuation of co-pending U.S. patent application Ser. No. 11/279,784, filed Apr. 14, 2006, which claims the filing benefit of U.S. Provisional Patent Application No. 60/676,878, filed May 2, 2005, each disclosure of which is hereby incorporated herein by reference in its entirety.

FIELD OF THE INVENTION

The present invention relates generally to shipping containers, and more particularly relates to shipping containers for shipping fragile products, such as glass bottles.

BACKGROUND OF THE INVENTION

Traditionally, containers for shipping glass products have generally included conventional cardboard box type shipping containers having different types of insulating material therein such as simple loose fill Styrofoam "peanuts," as an example. Another variety of conventional insulated shipping container utilizes panels or containers made of an insulating material, such as expanded polystyrene (EPS). While EPS may be formed into a desired shape and acceptable shock absorbent properties for many shipping needs, EPS is a relatively expensive insulating material.

Containers including EPS are often provided in a modular form. Individual sections of EPS are pre-formed using conventional methods, typically with beveled edges. The panels are then inserted into a conventional cardboard box type of shipping container, one section against each wall, to create an interior cavity within the container. In this arrangement, the beveled edges of adjacent panels form seams at the corners of the container. A product is placed in the cavity and a plug, such as a thick polyester foam pad, is placed over the top of the product before the container is closed and prepared for shipping. In some embodiments, an EPS panel is also included as part of a floor accepting a product bottom.

Alternatively, an insulated body may be injection molded from expanded polystyrene, forming a cavity therein and having an open top to access the cavity. A product is placed in the cavity, typically along with coolant, and a cover is placed over the open end, such as the foam plug described above or a cover foam from EPS.

For shipping particularly sensitive products, expanded rigid polyurethane containers are often used, as expanded polyurethane has properties genuinely superior to EPS. Typically, a cardboard container is provided having a box insert therein, defining a desired insulation space between the insert and the container. Polyurethane foam is injected into the insulation space, generally filling the space and generally adhering to the container at an insert. A foam plug may be placed over the product, or a lid may be formed from expanded polyurethane, typically having a flat or possibly inverted top hat shape.

Polyurethane containers use two cardboard boxes nested together with polyurethane injected into the space between the boxes. When polyurethane is injected into such a container, it adheres generally to the walls of both the inner and outer cardboard box. Thus, the cardboard and insulation may have to be disposed of together, preventing recycling of the container. Further, the cost of manufacturing, shipping, and installing EPS inserts with the cardboard containers is inefficient, plus the costs of shipping and installing cardboard containers that are capable of being broken down into manageable parts are relatively high. Accordingly, there is a need for an improved shipping container to maintain sensitive material, such as glass containers, while reducing the shipping space required and manufacturing resources. Various aspects and advantages of this invention will become apparent to those skilled in the art from the following detailed description and embodiments described herein.

SUMMARY OF THE INVENTION

The present invention overcomes the foregoing and other shortcomings and drawbacks of shipping containers heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a shipping container is provided for shipping fragile product, such as filled glass bottles for example. The shipping container is particularly designed to provide shock absorbing protection to the glass bottles received therein during transport and handling of the container.

In one embodiment, the shipping container includes an exterior cardboard shipping box, a generally rectangular liner, one or more cross-pieces, a top sheet or pad and a bottom sheet or pad received within the cavity of the box. The liner, cross-pieces, top sheet and bottom sheet may be made of corrugated cardboard or hexacomb material. The cross-pieces, in combination with the liner, define plural vertically extending receptacles for individually receiving glass bottles or other containers. The liner, cross-pieces, top sheet and bottom sheet provide shock absorbing capability to mitigate the impact of drops and bruises to packaging that can occur in transport. The receptacles are sized to snugly receive at least a portion of a mating side wall of a particular bottle or container being shipped so that the containers are not loose or movable from side to side within the receptacles. A pair of hand holes are formed in opposite sides of the corrugated box to facilitate lifting, carrying and handling of the container.

In one embodiment, the bottom sheet is placed at the bottom wall of the box. The generally rectangular liner is placed against the side walls of the box with its bottom peripheral edge generally abutting an upper surface of the bottom sheet. One or more cross-pieces are placed into the box cavity with the bottom edges of the cross-pieces also generally abutting the upper surface of the bottom sheet. The top sheet may be placed onto the top or cap sections of the glass containers with the top sheet located above the hand holes and snugly positioned between the cap sections of the containers and the closed top wall of the shipping container.

According to one aspect of the present invention, the liner may have a height that is less than the height of the shipping box. The liner may extend upwardly from the bottom sheet beyond a mid-height of the box, such as about two-thirds of the box height for example. The height of the liner may generally correspond to the height of the container side wall so that a top peripheral edge of the liner is positioned generally at or below the area where the container tapers inwardly toward the container neck. The top peripheral edge of the liner may be positioned below the pair of hand holes and spaced from the top sheet resting on the cap sections of the bottles. In one embodiment, the cross-pieces may have generally the same height as the liner.

The lower height of the liner enables the corners of the shipping box to crush or crumple to thereby absorb much of the energy from impact should the box be dropped on one of its upper corners. The hand holes are positioned above the top peripheral edge of the liner and the top edges of the cross-pieces so that the liner and cross-pieces do not interfere with the user's hands or obstruct gripping of the hand holes when the container is lifted or carried. Also, the lower height of the liner and cross-pieces facilitates easy placement and removal of the bottles.

In accordance with another aspect of the present invention, the pair of hand holes formed in the side walls of the box may be staggered relative to each other. For example, one of the hand holes may be slightly staggered in one direction relative to a vertical midplane intersecting the opposite side walls of the box while the other hand hole may be slightly staggered in an opposite direction relative to the vertical midplane. In one embodiment, each of the hand holes may at least partially overlap the vertical mid plane.

The staggered positioning of the hand holes enables ergonomic lifting and carrying of the entire package by placing the user's hands generally on opposite sides of the vertical midplane. This provides for more even weight distribution when the container is lifted and carried.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE PREFERRED EMBODIMENTS

Figure 1:
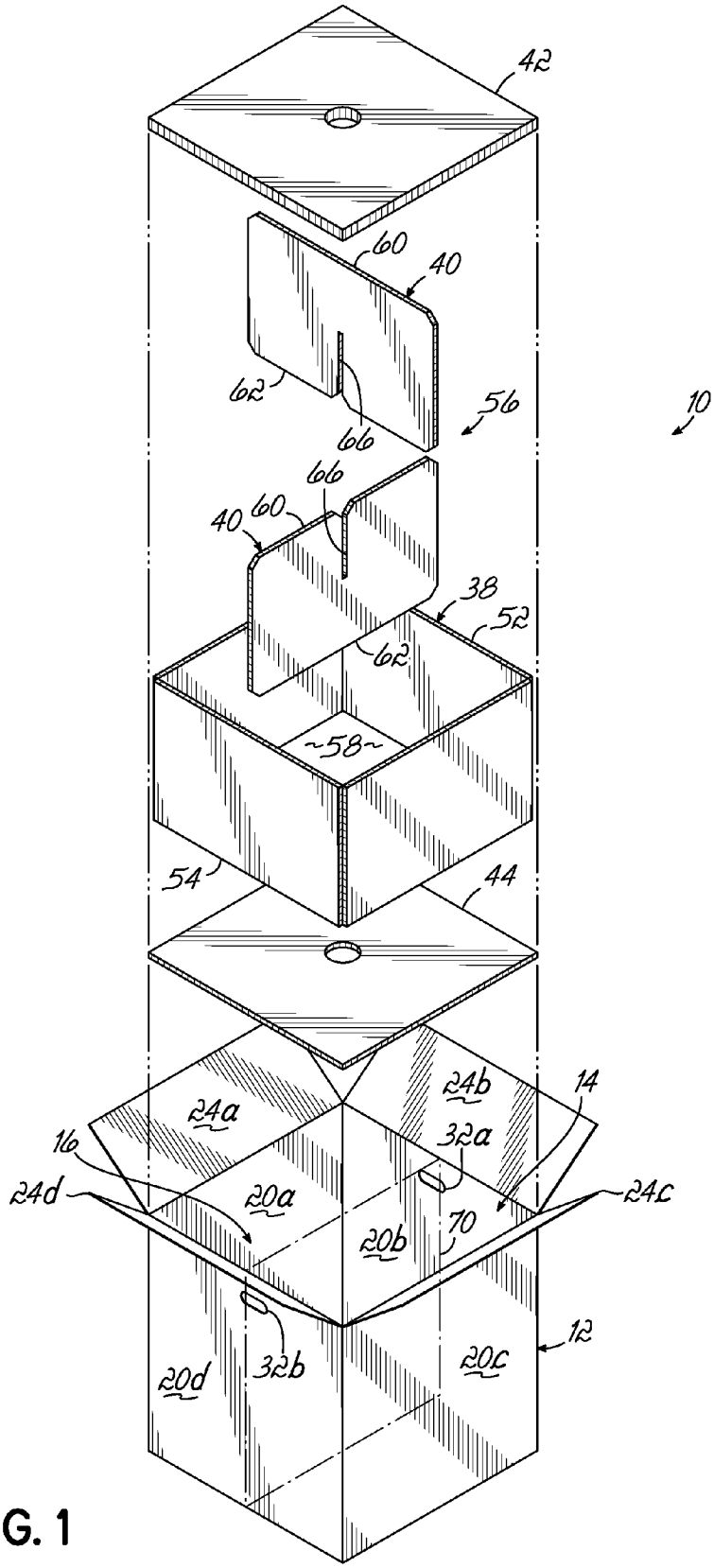
FIG. 1 is an exploded perspective view of a shipping container according to one embodiment of the present invention, including a shipping box, a liner, a pair of crosspieces, a top sheet and a bottom sheet.

Referring now to the figures, and to FIG. 1 in particular, an improved shock absorbing shipping container 10 is shown in accordance with one embodiment of the present invention. The container 10 generally includes an exterior cardboard shipping box or container 12, defining an upper opening 14 leading to a cavity 16, which is shown as general rectangular in the illustrated embodiment, and a lower opening (not shown), which may be closed by a plurality of flaps integral with the box. The flaps are conventional in the pertinent art.

Figure 2:
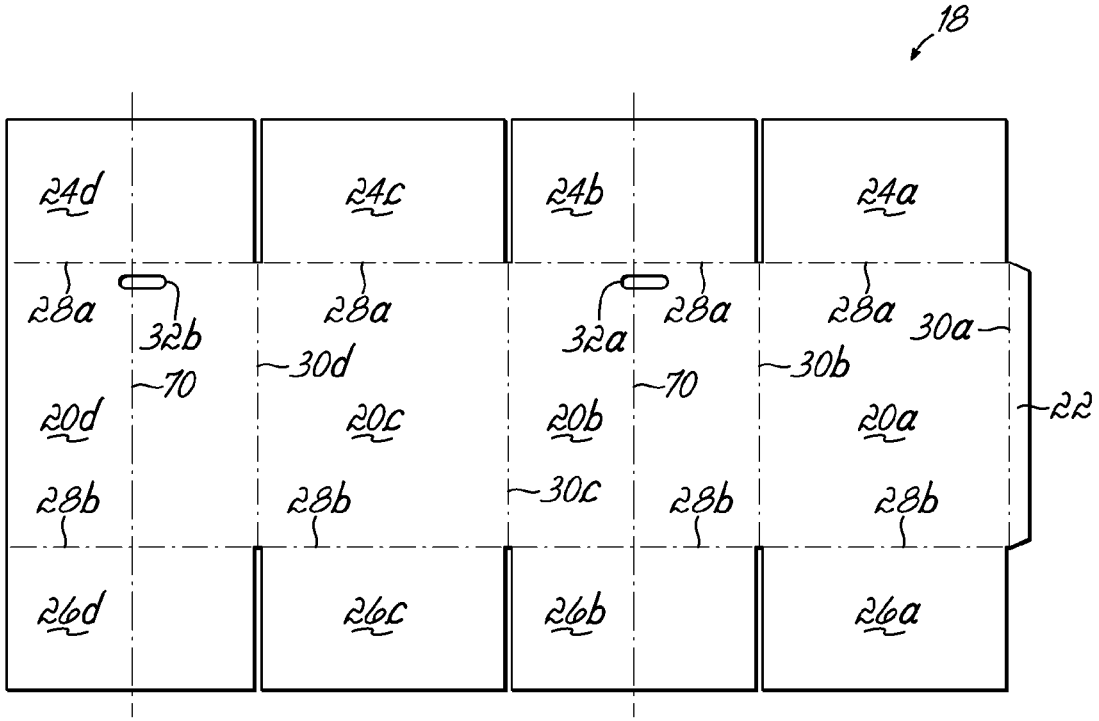
FIG. 2 is a top plan view of an exemplary corrugated blank for making the shipping box shown in FIG. 1.

One exemplary blank 18 for making the corrugated shipping box 12 is shown in FIG. 2. The blank 18 includes four side walls 20*a-d* and an assembly flap 22 running parallel to one another in a first direction, and eight closure flaps 24*a-d* and 26*a-d* extending parallel to one another in a second direction perpendicularly to the side walls 20*a-d*. Specifically, the blank 18 includes a first side wall 20*a* that is foldably connected to a first upper closure flap 24*a* along an upper fold line 28*a*. Also, the first side wall 20*a* is foldably connected to a first lower closure flap 26*a* along a lower fold line 28*b*,the attachment flap 22 along a first vertical fold line 30*a*,and the second side wall 20*b* along a second vertical fold line 30*b*. The upper and lower fold lines 28*a*, 28*b* generally oppose each other. The first and second vertical fold lines 30*a*, 30*b* also generally oppose each other.

The second side wall 20*b* is foldably connected to a second upper closure flap 24*b* along the upper fold line 28*a*. The second side wall 20*b* is also foldably connected to a second lower closure flap 26*b* along the lower fold line 28*b* and to the third side wall 20*c* along a third vertical fold line 30*c*. The second and third vertical fold lines 30*b*,30*c* generally oppose each other. The second wall 20*b* includes a first hand hole 32*a* formed therein as will be described in greater detail below.

The third side wall 20*c* is foldably connected to a third upper closure flap 24*c* along the upper fold line 28*a*. The third side wall 20*c* is foldably connected to a third lower closure flap 26*c* along the lower fold line 28*b* and to the fourth side wall 20*d* along a fourth vertical fold line 30*d*. The third and fourth vertical fold lines 30*c*,30*d* generally oppose each other.

The fourth side wall 20*d* is foldably connected to a fourth upper closure flap 24*d* along the upper fold line 28*a*. The fourth side wall 20*d* is also foldably connected to a fourth lower closure flap 26*d* along the lower fold line 28*b*. The fourth wall 20*d* includes a second hand hole 32*b* formed therein as will be described in detail below.

In other alternative embodiments, the upper and lower fold lines 28*a*,28*b* and vertical fold lines 30*a-d* may comprise score lines or other bendable or foldable structures well known to those of ordinary skill in the art. Also, the upper and lower fold lines 28*a*,28*b* may be distinct for each of the side walls 20*a-d*. Moreover, there may be more or fewer fold lines depending on the ultimate shape of the shipping box 12. Of course, other configurations of the blank 18 are possible as well without departing from the spirit and scope of the present invention.

In an assembled orientation as shown in FIG. 1, the first and fourth side walls 20*a*,20*d* are adjacent or nearly adjacent such that the attachment flap 22 may be attached to the fourth side wall 20*d*. The attachment may be accomplished, for example with glue, staples, interconnecting fiberboard pieces or other methods known in the art. In another embodiment, the attachment flap 22 could be foldably connected to the fourth side wall 20*d* instead of the first side wall 20*a*,and the attachment flap 22 may be glued, stapled, interconnected or the like to the first side wall 20*a*. In still another embodiment of the invention, the attachment flap 22 may be completely removed and other methods may be used to attach the first and fourth side walls 20*a*,20*d* to each other. A person of skill in the art will be able to imagine many ways of connecting the first and fourth side walls 20*a*,20*d* as desired. Attachment of the first and fourth side walls 20*a*,20*d* adds structural integrity to the container 12 once it is fully assembled, but it is not necessary for the present invention.

Since the first and third side walls 20*a*,20*c* oppose each other, the first and third lower closure flaps 26*a*,26*c* may be folded over at generally right angles along the fold line 28*b* such that the first and third lower closure flaps 26*a*,26*c* are generally planar. Either the first or the third lower closure flap 26*a* or 26*c* may be folded over first, followed by whichever is remaining. The first and the third lower closure flaps 26*a* or

26*c*,once folded, may be sealed or attached to each other, for example, with staples, tape, or glue. The second and fourth lower closure flaps 26*b*,26*d* also oppose each other, and may be folded at generally right angles along the fold line 28*b* such that the second and fourth lower flaps 26*b*,26*d* overlap the first and third lower closure flaps 26*a*,26*c*. The second and the fourth lower closure flaps 26*b* or 26*d*,once folded, may also be sealed or attached to each other, for example, with staples, tape, or glue.

In one embodiment, the bottom wall 34 (FIGS. 5-7) of the container 12 may comprise the first, second, third, and fourth lower closure flaps 26*a-d* that may be folded at generally right angles to the first, second, third and fourth side walls 20*a*-20*d* and interconnected to each other into a crash-bottom style. The crash-bottom style is only one of many possibilities for the bottom wall 34 of the container 12. The bottom wall 34 of the container 12 may include two to four generally square or rectangular lower flaps foldably connected to the side walls 20*a-d*. In that case, the lower flaps may be folded to overlap each other and then glued, taped, or stapled together as described above. Alternatively, the bottom wall 34 may be a square or rectangular piece of material stapled, taped, or glued to the first, second, third and fourth side walls 20*a-d* or comprise a wall or panel in an alternative configuration of the blank 18. Those of ordinary skill in the art will be able to imagine many different possibilities for the bottom wall 34 of the container 12. The choice of material for the container bottom wall 34 will depend on the articles that are to be placed in the container 12. For example, heavy articles that assert a substantial force upon the bottom wall 34 of the container 12 may need the four generally square rectangular flaps stapled together to support the heavy articles.

Similarly, in one embodiment, the top wall 36 (FIGS. 5-7) of the container 12 may comprise the first, second, third, and fourth upper closure flaps 24*a-d* that may be folded at generally right angles to the first, second, third and fourth side walls 20*a-d* and interconnected to each other. The top wall 36 of the container 12 may include two to four generally square or rectangular upper flaps foldably connected to the side walls 20*a-d*. In that case, the upper flaps may be folded to overlap each other and then glued, taped, or stapled together as described above. Other configurations of the top wall 36 are possible as well without departing from the spirit and scope of the present invention.

The blank 18 may be cut and scored with conventional fiberboard stock using conventional die cutting apparatuses. The thickness of the stock and the material used as stock will depend upon the weight of the articles to be carried in the container 12. Typically, the stock will be corrugated cardboard, but it may also be any material known in the art that is used to make containers where the material may be folded as previously described. In the one embodiment, the first and fourth side walls 20*a*,20*d* may share a common dimension, while the second and third side walls 20*b*,20*c* may share a common dimension that may be different from the common dimension of the first and fourth side walls 20*a*,20*d*.

Figure 4:
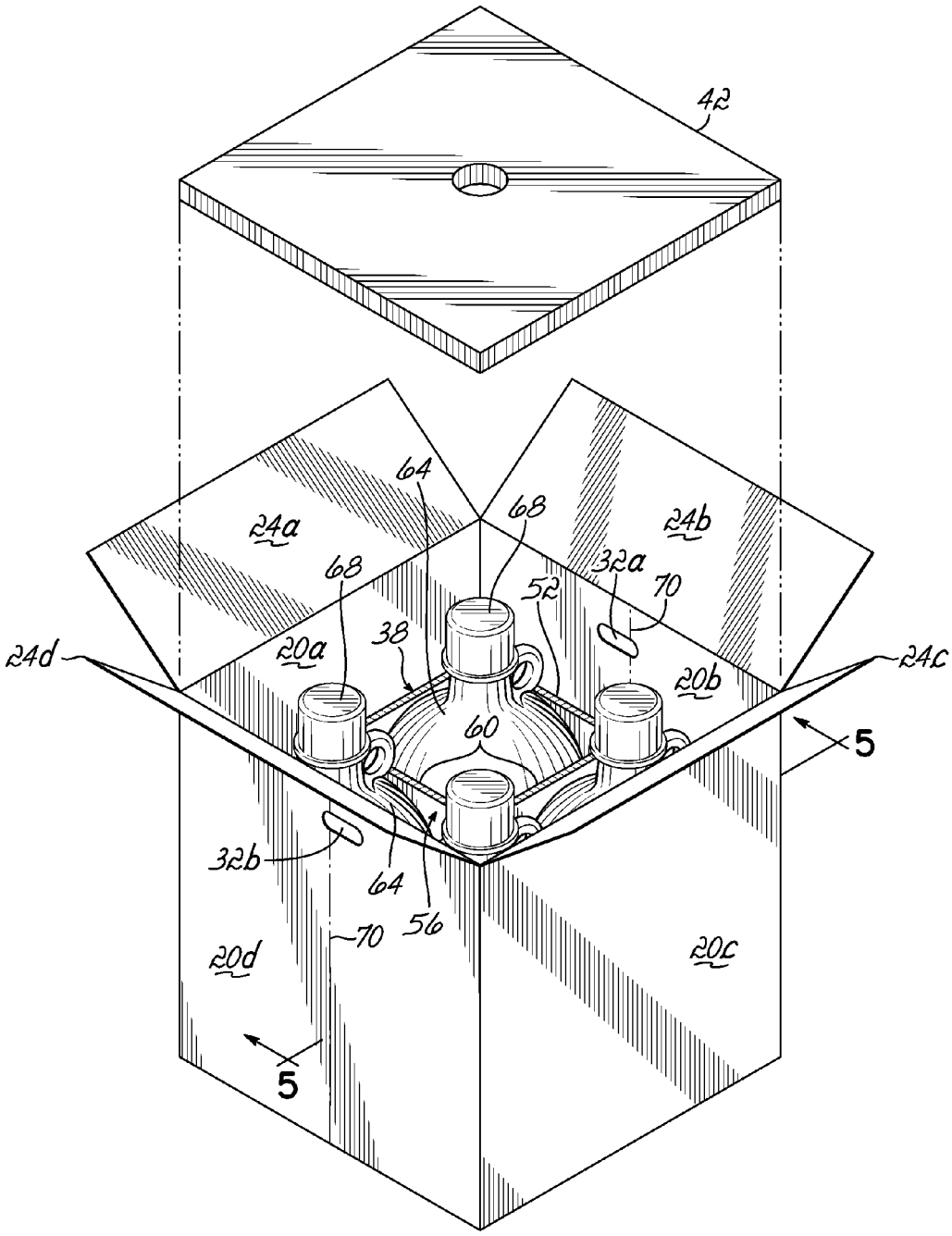
FIG. 4 is a perspective view of the shipping container shown in FIG. 1, illustrating the shipping container partially assembled and containing four glass bottles.
Figure 5:
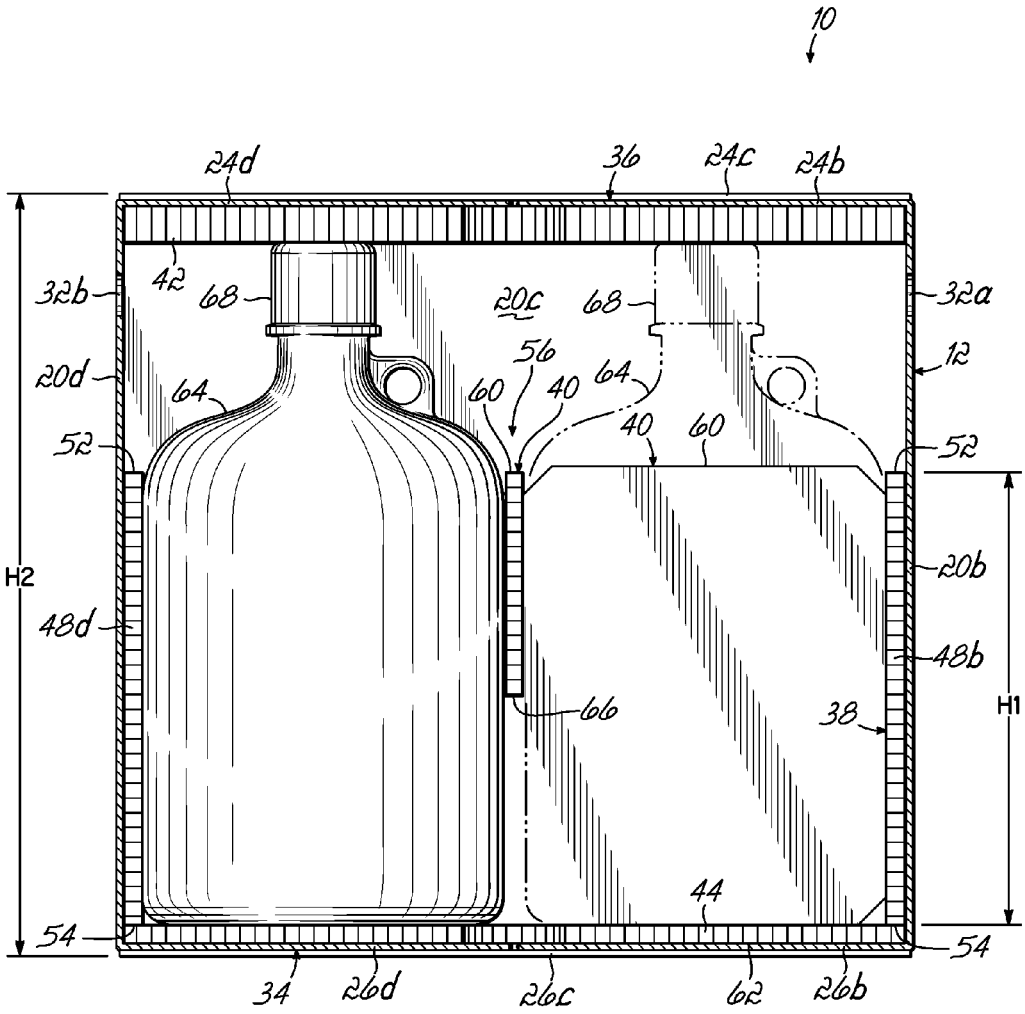
FIG. 5 is a cross-sectional view taken along line 5-5 of FIG. 4, illustrating with the shipping container fully assembled.

In one embodiment of the present invention, as shown in FIGS. 1, 4 and 5, the shipping container 10 includes a generally rectangular liner 38, one or more cross-pieces 40, a top sheet or pad 42 and a bottom sheet or pad 44 received within the cavity 16 of the box 12. The liner 38, cross-pieces 40, top sheet 42 and bottom sheet 44 may be made of corrugated cardboard or hexacomb material. For example, the liner 38, cross-pieces 40 and bottom sheet 44 may comprise ¾" hexacomb material. The top sheet 42 may be thicker, and comprise 1¼' hexacomb material for example. It will be understood that other thicknesses of the liner 38, cross-pieces 40, top sheet and a bottom sheet are possible as well and that one or more of these components may be sheathed on the inner and/or outer surfaces thereof with a plastic film or other suitable liquid barrier material.

Figure 3:
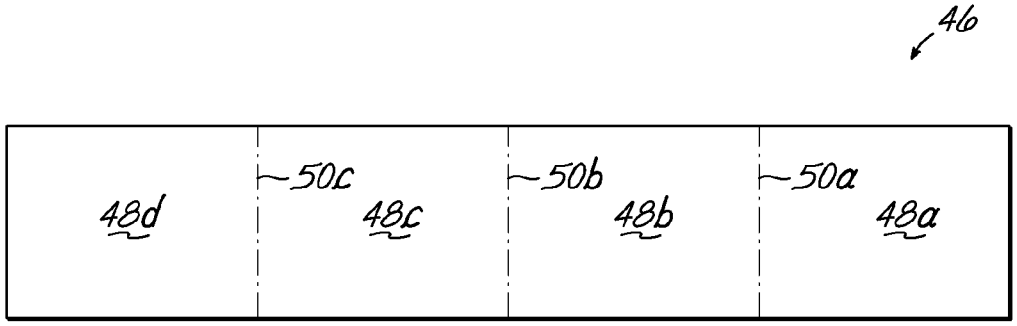
FIG. 3 is a top plan view of an exemplary corrugated blank for making the liner shown in FIG. 1.

One exemplary blank 46 for making the liner 38 is shown in FIG. 3. The blank 46 includes four side panels 48*a-d* running parallel to one another in the first direction. Specifically, the blank 46 includes a first panel 48*a* foldably connected to a second panel 48*b* along a first fold line 50*a*. The second panel 48*b* is foldably connected to a third panel 48*c* along a second fold line 50*b*. The third panel 48*c* is foldably connected to a fourth panel 48*d* along a third fold line 50*c*. In the one embodiment, each of the panels 48*a-d* may share a common dimension.

Further, as can be seen in FIGS. 1, 4 and 5, the arrangement of the first, second, third and fourth side panels 48*a-d* may be foldably connected in any order that allows adjacent panels to be folded at generally right angles to one another such that the first and third panels 48*a*,48*c* oppose each other and the second and fourth panels 48*a*,48*d* oppose each other. In its folded configuration as shown in FIG. 1, the liner 38 defines a top peripheral edge 52 and an opposite bottom peripheral edge 54. The liner 38 may be placed inside the box cavity 16 such that the side panels 48*a-d* of the liner 38 generally abut the side walls 20*a-d* of the box 12 as may be seen in FIGS. 4 and 5.

In one embodiment, as shown in FIGS. 1, 4 and 5, a shock absorbing cross-piece assembly 56, comprising a pair of identical assembled cross-pieces 40, is received within a cavity 58 (FIG. 1) defined by the liner 38. Each cross-piece 40 defines a top edge 60 and a bottom edge 62 depending on the orientation of the cross-piece 40. This cross-piece assembly 56 is essentially a shape-retaining, but also yieldable, grid structure providing, in combination with the liner 38, plural vertically extending receptacles for individually receiving glass bottles 64 or other containers, as will be further explained. The cross-piece assembly 56 may be formed from corrugated cardboard or hexacomb material. In one embodiment, the cross-piece assembly 56 defines four (4) receptacles, which are arranged in a 2-by-2 array. However, it will be understood that the container 10 may define as few as a single receptacle or any number of multiple receptacles. Also, while the container 10 is described herein as being sized and configured to receive filled glass bottles 64, the invention is not so limited. However, the shipping container 10 will specifically provide glass bottles 64 superior shock absorbing protection to the material in those containers or packages.

Importantly, the receptacles are sized to snugly receive at least a portion of a mating side wall of a particular bottle or container 64 being shipped, so that the containers 64 are not loose or movable from side to side within the receptacles. Consequently, a given size of box 12 with a given size of box cavity 16 may be used to ship containers 64 of differing sizes by varying the size of the receptacles defined by the cross-pieces 40 used within the shipping container 10. In each case, however, the liner 38 may be used for spacing the receptacles 64 from the inside surface of the side walls 20*a-d* of the box 12.

As is best seen in 1, 4 and 5, in order to define the four receptacles, each as an element in a 2-by-2 matrix, two cross-pieces 40 are assembled at generally right angles to each other. Each of the cross-pieces 40 has a slot 66 that mates with a corresponding slot 66 of the other cross-piece 40. Each cross-piece 40 is mated to the other cross-piece 40 by mating the mating slots 66 of each cross-piece 40 at generally right angles.

In one embodiment, as shown in FIGS. 1 and 5, the bottom sheet 44 is placed at the bottom wall 34 of the box 12. The bottom sheet 44 may substantially cover the bottom wall 34 of the box 12 beneath the bottles 64. The liner 38 may be placed against the side walls 20*a-d* of the box 12 with its bottom peripheral edge 54 generally abutting an upper surface of the bottom sheet 44. The cross-piece assembly 56 is placed into the box 12 with the bottom edges 62 of the cross-pieces 40 also generally abutting the upper surface of the bottom sheet 44 and forming the four receptacles in the illustrated embodiment. The top sheet 42 may be placed onto the top or cap sections 68 of the glass containers 64 with the top sheet 42 located above the hand holes 32*a*,32*b* and snugly positioned between the cap sections 68 of the containers 64 and the closed top wall 36 of the shipping container 10 as shown in FIG. 5. The top sheet 42 may extend substantially to the side walls 20*a-d* of the shipping box 12 as shown in the figures.

The bottles 64 to be received in the receptacles are typically glass and thus are frangible, and are filled with a relatively heavy liquid material to be shipped. That is, the weight of the liquid material may be several times the weight of the frangible glass containers 64. Further, the bottles 64 themselves may carry exterior labeling or other indicia that must be protected from scuffing or damage in shipping. Finally, the content of the bottles 64 may not be exposed to extremes of temperature during shipping or the contents will be damaged or destroyed. Further, although the present inventive shipping container 10 is especially arranged, configured, and constructed to accommodate glass containers 64, and to protect these glass containers 64 during shipping by providing shock absorption, while also providing a temperature regulated environment to protect and preserve the contents of the containers 64, the invention is not so limited. In other words, the present invention may be used to ship temperature sensitive materials that are in bottles made of plastic, or which are not in bottles at all. That is, material to be shipped could be packed in individual shipping containers each inserted into a respective receptacle of the shipping container 10. These individual shipping packages or containers may themselves be made of glass, plastic, paper, wax, fiberglass, or a variety of other materials. The shipping container 10 will specifically provide glass containers superior shock absorbing protection to the material in those containers or packages.

In accordance with one aspect of the present invention, as may be seen in FIG. 5, the liner 38 may have a height H1 that is less than a height H2 of the shipping box 12. The liner 38 is supported on the bottom sheet 44 with the top peripheral edge 52 of the liner 38 positioned below the pair of hand holes 32*a*,32*b* and spaced from the top sheet 42 resting upon the cap sections 68 of the bottles 64. The liner 38 may extend upwardly from the bottom sheet 44 beyond a mid-height of the shipping container 10, such as about two-thirds of the box height H2 by way of example as shown in FIG. 5. The cross-pieces 40 are also supported on the bottom sheet 44 with the top edges 60 of the cross-pieces 40 spaced from the top sheet 42. In one embodiment, the cross-pieces 40 may have generally the same height dimension as the liner 38. In one embodiment, the liner 38 and the cross-pieces 40 each have a height that generally corresponds to the height of the container side wall so that the top peripheral edge 52 and top edges 60 are positioned generally at or below the area where the container 64 tapers inwardly toward the container neck. The lower height of the liner 38 enables the corners of the shipping box to crush or crumple to thereby absorb much of the energy from impact should the box 12 be dropped on one of its upper corners. The hand holes 32*a*,32*b* are positioned above the top peripheral edge 52 of the liner 38 and the top edges 60 of the cross-pieces 40 so that the liner 38 and cross-pieces 40 do not interfere with the user's hands or obstruct gripping of the hand holes 32*a*,32*b* when the container 10 is lifted. Also, the lower height of the liner 38 and cross-pieces 40 facilitates easy placement and removal of the bottles 64.

Figure 6:
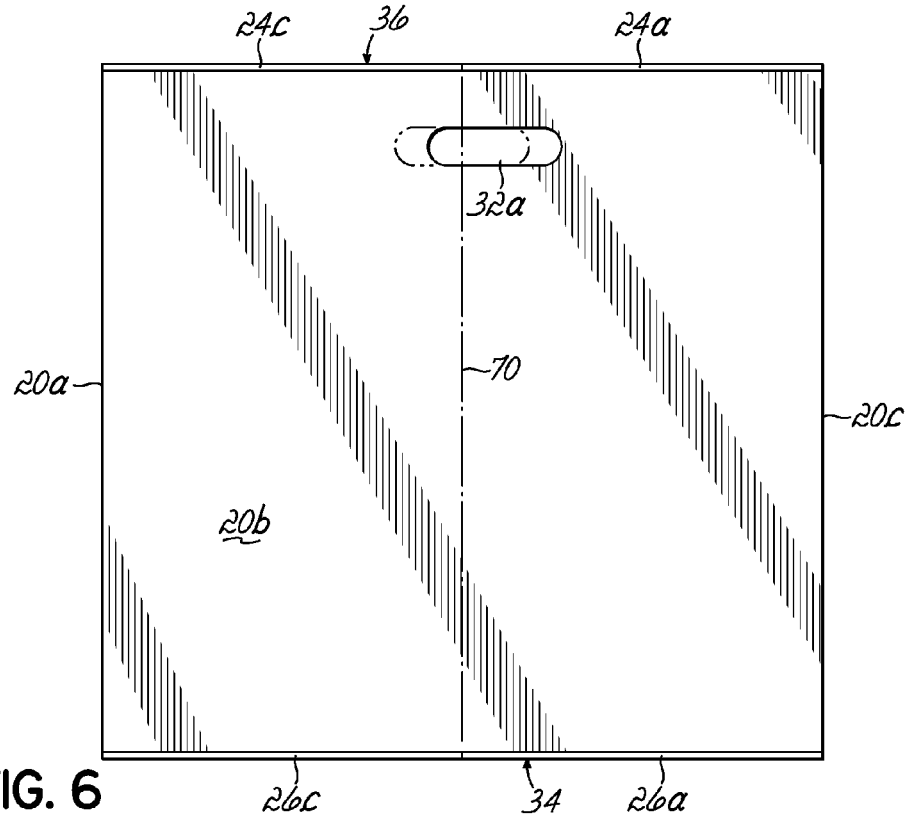
FIG. 6 is a side elevational view of the assembled shipping container shown in FIG. 4, illustrating a staggered hand hole formed in one of the side walls of the shipping container.
Figure 7:
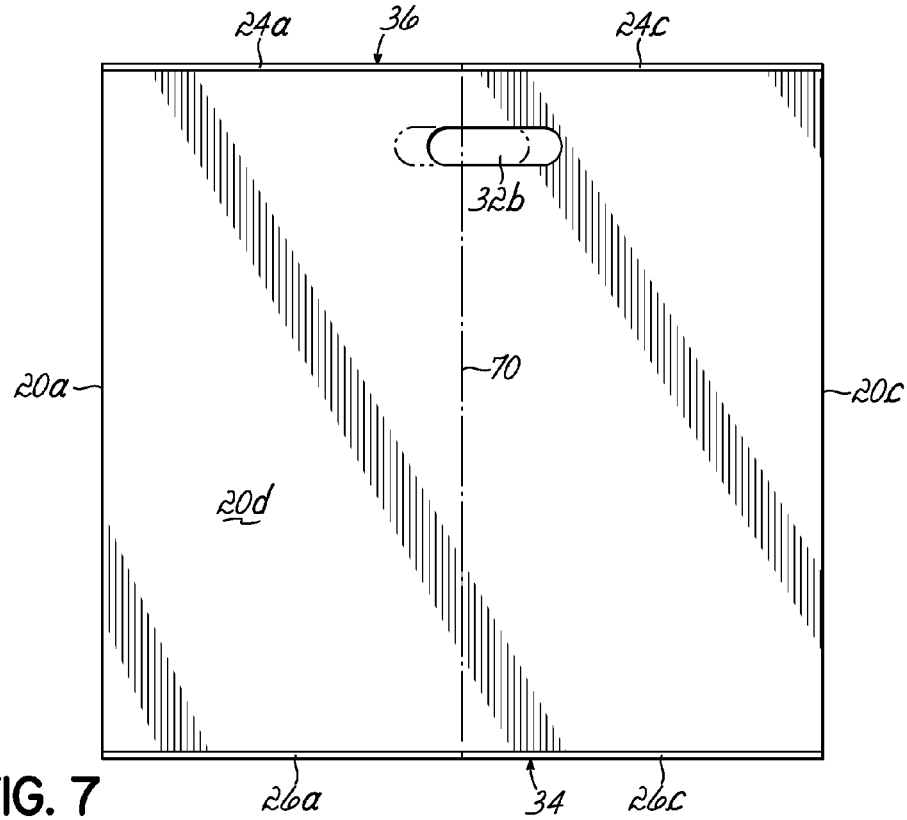
FIG. 7 is a side elevational view illustrating a staggered hand hole formed in the opposite side of the shipping container shown in FIG. 6.

In accordance with another aspect of the present invention, the pair of hand holes 32*a*,32*b* formed in the side walls 20*b*,20*d* may be staggered relative to each other as shown in FIGS. 1, 2, 4, 6 and 7. For example, the first hand hole 32*a* formed in side wall 20*b* may be slightly staggered in one direction relative to a vertical midplane 70 intersecting the second and fourth side walls 20*b*,20*d* (i.e., in a direction toward the side wall 20*a*). The second hand hole 32*b* formed in side wall 20*d* may be slightly staggered in an opposite direction relative to the vertical midplane 70 (i.e., in a direction toward the side wall 20*c*). In one embodiment, each of the hand holes 32*a*,32*b* may at least partially overlap the vertical midplane 70 as shown in FIGS. 1, 2, 4, 6 and 7. For example, in one embodiment each hand hole 32*a*,32*b* may have a longitudinal length of about 3½" and each of the hand holes 32*a*,32*b* may be offset in opposite directions relative to the vertical by about 1" as shown in FIGS. 6 and 7. Alternatively, the hand holes 32*a*,32*b* may be provided with greater or lesser offset.

The staggered positioning of the hand holes 32*a*,32*b* enables ergonomic lifting and carrying of the entire package by placing the user's hands generally on opposite sides of the vertical midplane 70. This provides for more even weight distribution when the container 10 is lifted and carried. It will be understood that other staggered and unstaggered positions of the hand holes 32*a*,32*b* are possible as well.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. The invention in its broader aspects is, therefore, not limited to the specific details, representative apparatus and method, and illustrative examples shown and described. Accordingly, departures may be made from such details without departing from the spirit or scope of the general inventive concept.

Having described the invention, we claim:

1. A shipping container, comprising:

a box having a top wall, a bottom wall, a first pair of opposite side walls and a second pair of opposite side walls defining a cavity for receiving one or more articles placed therein;

a hand hole formed in each of the first pair of side walls; and a liner having a first pair of opposite side walls and a second pair of opposite side walls disposed within the cavity of the box and having a top peripheral edge and a bottom peripheral edge, wherein the first pair of side walls of the liner generally abuts the first pair of side walls of the box and the second pair of side walls of the liner generally abuts the second pair of side walls of the box, and further wherein the liner is disposed within the cavity of the box with the top peripheral edge on each of the first pair of side walls of the liner extending between the second pair of side walls of the liner and being disposed beneath each of the hand holes along the entire length of the top peripheral edge between the second pair of side walls of the liner;

at least one cross-piece having a top edge and a bottom edge disposed within the cavity of the box and being configured to separate at least two articles placed therein, the top edge of the at least one cross-piece being disposed beneath each of the hand holes; and a top sheet disposed within the cavity of the box and located above the hand holes, the top sheet contacting an upper portion of an article when the article is placed within the cavity with the top peripheral edge of the liner and the top edge of the at least one cross-piece being spaced from the top sheet.

2. The shipping container of claim 1 further comprising a pair of cross-pieces each having a top edge and a bottom edge disposed within the cavity of the box and extending generally transverse to each other, the pair of cross-pieces being configured to separate four articles placed into the cavity and the respective top edges of the pair of cross-pieces being disposed beneath each of the hand holes.

3. The shipping container of claim 1 further comprising a bottom sheet supported by the bottom wall of the box.

4. The shipping container of claim 3 wherein the liner is supported by the bottom sheet with the bottom peripheral edge of the liner generally abutting the bottom sheet.

5. The shipping container of claim 3 wherein the at least one cross-piece is supported by the bottom sheet with the bottom edge of the at least one cross-piece generally abutting the bottom sheet.

6. The shipping container of claim 1, wherein the box is formed from corrugated material.

7. The shipping container of claim 1, wherein the liner is formed from corrugated material.

8. The shipping container of claim 1, wherein the at least one cross-piece is formed from corrugated material.

9. The shipping container of claim 3, wherein the bottom sheet is formed from corrugated material.

10. The shipping container of claim 1, wherein the top sheet is formed from corrugated material.

11. The shipping container of claim 1, wherein each of the hand holes is staggered in opposite directions relative to a vertical midplane intersecting the first pair of side walls.

* * * * *